US005729848A

United States Patent [19]

Yamagishi

[11] Patent Number: 5,729,848

[45] Date of Patent: Mar. 24, 1998

[54] BED WITH A WASH TUB FOR PUBES

[75] Inventor: Tooru Yamagishi, Tokyo, Japan

[73] Assignee: Yukigaya Precision Industry Co., Ltd., Miyagi, Japan

[21] Appl. No.: 530,259

[22] PCT Filed: Apr. 6, 1995

[86] PCT No.: PCT/JP95/00670

§ 371 Date: Aug. 28, 1995

§ 102(e) Date: Aug. 28, 1995

[87] PCT Pub. No.: WO95/27466

PCT Pub. Date: Oct. 19, 1995

[30] Foreign Application Priority Data

Apr. 11, 1994 [JP] Japan ..... 6-095493

[51] Int. Cl.[6] ..... A47K 7/08; A61H 35/00

[52] U.S. Cl. ..... 5/606; 5/604; 4/547; 4/584

[58] Field of Search ..... 4/546, 547, 584, 4/585, 587, 588; 5/606, 604

[56] References Cited

U.S. PATENT DOCUMENTS 202,116 4/1878 Price ..... 5/606

963,538 7/1910 Ford ..... 5/604

3,066,312 12/1962 Reavis ..... 4/585

FOREIGN PATENT DOCUMENTS 8902260 3/1989 WIPO ..... 5/606

*Primary Examiner*—Steven N. Meyers

*Assistant Examiner*—Robert G. Santos

*Attorney, Agent, or Firm*—Sughrue, Mion, Zinn, Macpeak & Seas, PLLC

[57] ABSTRACT

A bed with a wash tub for pubes which may reduce nursing work loads and improve conditions of the patients during the washing. The bed 3 with a wash tub for pubes comprises a main frame 5 with legs 5, and a wash tub 21 for pubes positioned at the center of the main frame 5, a mattress 11, 13, 15, laid on the main frame. The wash tub 21 for pubes has a tub body 23, a pair of left and right hip supports 25 partially provided in the tub, a hot water supply means 29 which supplies hot water to a col portion between the hip supports and a drain 31. The patient's hips 2 are placed on the paired hip supports 25 and then the col portion between the hip supports 25 is showered with a hot water to wash the pubes of the patient successfully.

5 Claims, 3 Drawing Sheets

BED WITH A WASH TUB FOR PUBES

BACKGROUND OF THE INVENTION

The present invention relates to a bed having a wash tub for pubes for washing pubes of bedridden people, particularly to a bed with a wash tub for pubes which has been improved in order to simplify washing work and reduce work loads of nursing personnel in taking care of patients.

1. Conventional Art

Several types of beds (nursing bed) for disabled people such as bedridden aged people are equipped with portable bathtubs or toilet bowls therebelow. These facilities have assisted nursing persons in reducing their work loads in taking care of patients who are unable to walk to toilets for excretions or to bathrooms for bathing.

2. Tasks to be Solved by the Invention

Even though such a nursing bed is used, a work load of a nursing person has been still heavy. Particularly, when nursing work is carried out in a normal house and by a house wife, who is sometimes old and not physically strong, physical labor during nursing accumulates to a serious level. Such a burden often brings about a backache to the nursing person.

When a washing system for pubes with poor capability had to be used, it was impracticable to wash a wide area around pubes of the patient.

Under the above described circumstances, in nursing bedridden aged people and the like, diapers are worn, and at the practical utmost, their pubes and surrounding areas are wiped with napkins or towels after evacuations. Under such grade of cleaning, it is pointed out that germs such an colitis increase around pubes of the patients to cause complications.

It is an object of the present invention to provide a bed with a wash tub for pubes which may reduce nursing work loads and improve conditions of the patients during the washing.

SUMMARY OF THE INVENTION

In order to achieve the above object, the bed with a wash tub for pubes of the present invention comprises a main frame with legs, a wash tub for pubes positioned at the center of the main frame, a mattress laid on the main frame; and it is characterized in that the wash tub has a tub body, a pair of left and right hip supports partially provided in the tub, a hot water supply means which supplies hot water to a col portion between the hip supports and a drain means. In this equipment, the col portion between the hip supports means the sunken portion between the pair of hip supports.

In the bed with a wash tub for pubes of the present invention, when the mattress over the wash tub is removed, the wash tub is positioned just under the hips of the bedridden person. Thus, washing is carried out with barely moving the patient. The patient's hips are placed on the paired hip supports which are adapted for such use, and then the col portion between the hip supports is showered with a hot water to wash the pubes of the patient successfully.

DESCRIPTION OF THE PREFERRED EMBODIMENT

Now an embodiment of the present invention is described.

Figure 1:
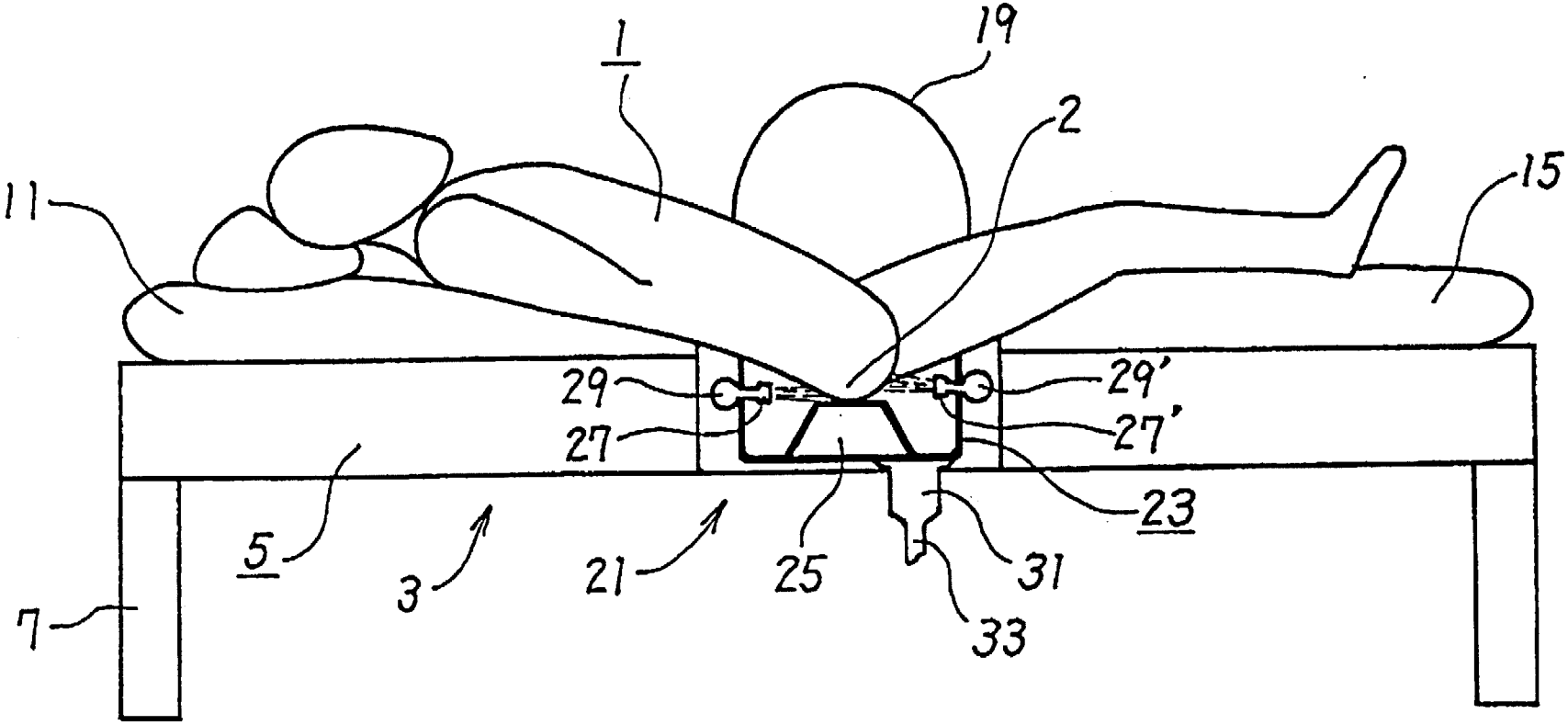
FIG. 1 is a partly cross-sectional side view showing a bed with a wash tub for pubes in use in accordance with an embodiment of the present invention.

FIG. 1 is a partly cross-sectional side view showing an operational state of the bed with a wash tub for pubes in accordance with an embodiment of the present invention. This bed 3 with a wash tub for pubes is composed of a main frame 5 with legs 7, a wash tub 21 for pubes, mattresses 11 and 15.

The wash tub 21 for pubes is located mostly at the center of the main frame 5 in a longitudinal direction (length direction of the bedridden person) and in (or slightly below) the main frame 5. The wash tub 21 for pubes is composed of a tub body 23, hip supports 25, washing nozzles 27, 27' for pubes, a drain trap 31 and drainpipes 33, etc. The tub body 23 is a shallow basin having depth of 10 to 20 cm and made of plastics, ceramics or stainless steel, etc. The hip supports 25 are projections for supporting the patient's hips. The washing nozzles 27 and 27' for pubes are for directing hot water shower to the pubes of the patient 1. The drain trap 31 is for catching bigger solids in the drain. The drainpipe 33 is for transferring drainage to the sewer. The tent 19 is for preventing splash of the shower from spreading.

Figure 2:
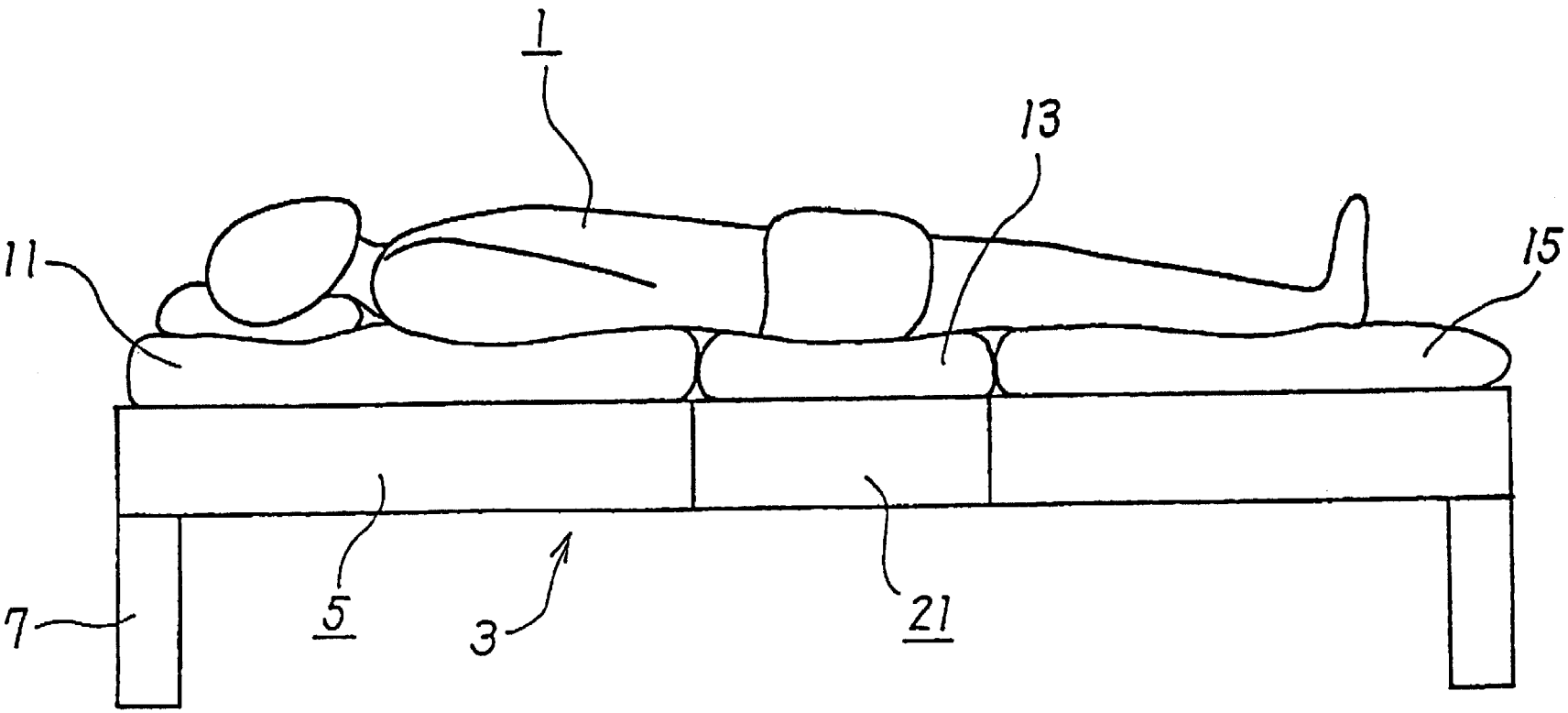
FIG. 2 is a side view showing an unoperational state of the bed with a wash tub for pubes of the FIG. 1.

FIG. 2 is a side view showing an unoperational state of the bed with a wash tub for pubes of the FIG. 1. A hip mattress 13 is placed on the wash tub 21. The patient 1 is lying on the bed 3 wearing a diaper. The hip mattress 13 acts also as a lid over the wash tub 21 and is composed of a plate member, which is a strength member and a lid, and a mattress member. The hip mattress 13 is divided into two in the left and right direction (the lateral direction of the person on the bed) in order to be easily removed and attached.

Figure 3:
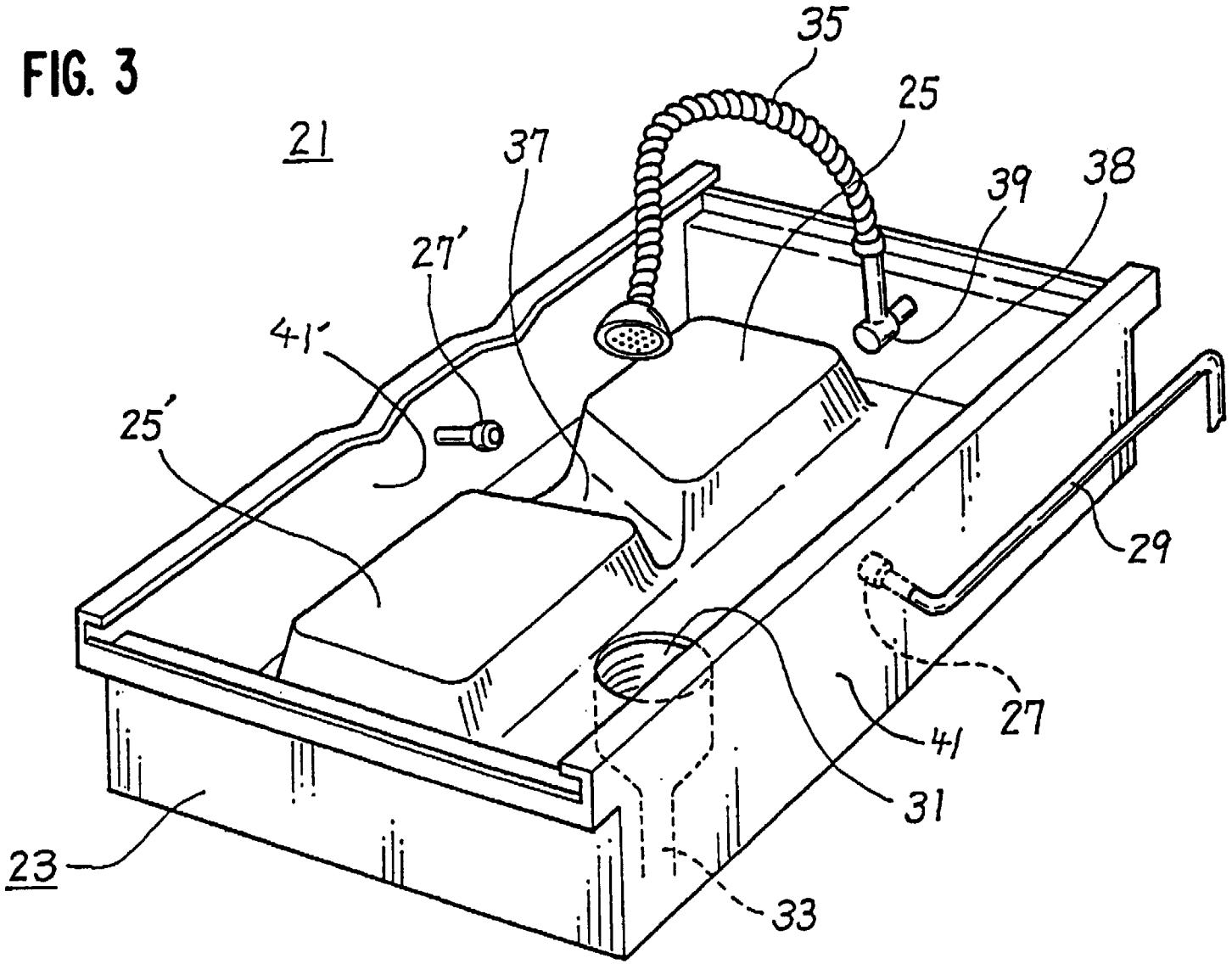
FIG. 3 is a schematic view showing the wash tub of the bed with a wash tub for pubes in the FIG. 1.

FIG. 3 is a schematic view showing the wash tub of the bed with a wash tub for pubes of the FIG. 1. As shown in FIG. 3, the hip supports 25 and 25' are provided as a pair of islands which protrude from the bottom 38 of the tub 23. The washing nozzles 27 and 27' for pubes are provided to extrude from the side walls 41 and 41' of the tub body 23, and shower from the nozzles are directed toward the upper area over the col potion 37 (just around the pubes of the patient) from back and front to wash effectively around the pubes of the patients. The washing nozzles 27 and 27' for pubes are provided with hot water by pipes 29 and 29'.

The bed with a wash tub for pubes is further equipped with a flexible shower 35 as a hot water supply means, and the flexible shower 35 may be directed to shower with hot water around the col potion 37 when used and may be accommodated in the tub body 23 when not in use. The shower 35 is equipped with a rotary joint in its lower end. By rotating this rotary joint 39, or by bending the shower hose, the shower 35 may be accommodated in the tub body 23. The shower 35 may be preferably capable of self standing without support by hands when it is directed toward the pubes of the patients, since the nursing person may wash the patient using both of his or her hands. The shower may be directed to anywhere around the pubes to clean it up sufficiently.

The drain trap 31 is attached at the lowest part of the bottom 38 of the tub body 23. Drainage gathers to the drain trap 31, and bigger solids in the drainage is captured. Disposable bag filters may be used for this trap. Drainage which have run through the drainpipe 31 is forwarded through the drainpipe 33 to sewer (or drain pond). Driving pumps (suction pumps) may be installed on a way of the drainpipe.

Now the operation of the bed is described. When the patient makes a sign, the nursing person removes the covers, etc. without delay. In this occasion, the left and right hip mattresses should be removed one by one. Thus the patient hips are placed on the hip supports 25 of the tub body 23. The night clothes (lower half) of the patient and the diaper are taken off and the tent 19 for shower splash guard is set around the hip. After temperature of the water flow (semi-hot water) from a water heater is adjusted, the valve handle is turned on to wash pubes, hips and anal by water spray from the shower.

When the diaper is taken off, it can be pulled out through the col portion 37 between the hip support 25. Accordingly, physical labor of the nursing person in exchanging diapers is reduced.

Washing by shower spray functions as massage and urges discretion and urination. After an automatic washing, the flexible shower is used for cleaning off residuals and the tub. Then, the tent for preventing splashing is removed. After washing, the patient's body and the tub is wiped off. The patient is diapered, and the left and right hip mattress (also lids of the tub) are settled back. Then, the patient is dressed with a night clothes and covered with the blanket to finish a series of work.

As clearly understood from the above descriptions, the present invention achieves the following advantageous effects:

(1) A bed is provided by which pubes of bed ridden patients may be washed while they are lying on the bed. Such a feature is not observed in conventional products in the market.

(2) A bed with a wash tub for pubes is provided by which work loads of the nursing person is greatly reduced, and the patient's pubes are washed, while the patient can be kept in a reasonably comfortable state.

Considering the present state where most of nursing work for bedridden people are conducted by older women, nursing people are physically and mentally burdened to a considerable grade. Preparation for coming aging society has not been made to a satisfactory level in the both field of software and hardware. The present invention may greatly reduce heavy work loads of the nursing person and help him/her to conduct his/her nursing work comfortably.

I claim:

1. A bed with a wash tub for pubes comprising:

a main frame defining a horizontal support for a person lying substantially in a prostrate position and having support legs, a wash tub for pubes positioned at the center of the main frame and below said horizontal support, a mattress laid on said horizontal support of the main frame; characterized in that the wash tub comprises a tub body having a bottom and sidewall portions, a pair of left and right hip supports supported from said tub bottom and projecting upward to define therebetween a col portion, a water supply which supplies water to said col portion between the hip supports and a drain in the bottom of the tub.

2. The bed with a wash tub for pubes according to claim 1 wherein said hot water supply comprises a nozzle which spouts hot water shower toward an upper area over the col portion.

3. The bed with a wash tub for pubes according to claim 1 wherein said hot water supply comprises a flexible shower hose and head which may be manually directed to shower with hot water around said col portion when in use and may be accommodated in said tub body when not in use.

4. The bed with a wash tub for pubes according to claims 1, 2 or 3 wherein said mattress comprises an upper body portion, a lower body portion and a hip portion divided into a pair of the left and the right half.

5. The bed with a wash tub for pubes according to claim 1 wherein said sidewall portions are delimited by a top rim portion and said hip supports do not extend above said rim portion.

* * * * *